US009113277B2

(12) United States Patent
Ball et al.

(10) Patent No.: US 9,113,277 B2
(45) Date of Patent: Aug. 18, 2015

(54) SKULL VIBRATIONAL UNIT

(75) Inventors: Geoffrey Ball, Axams (AT); Peter Lampacher, Innsbruck (AT); Wolfgang Amrhein, Ottensheim (AT); Gunther Weidenholzer, Ottensheim (AT)

(73) Assignee: Vibrant Med-El Hearing Technology GmbH, Innsbruck (AT)

( * ) Notice: Subject to any disclaimer, the term of this patent is extended or adjusted under 35 U.S.C. 154(b) by 836 days.

(21) Appl. No.: 12/634,940

(22) Filed: Dec. 10, 2009

(65) Prior Publication Data

US 2010/0145135 A1 Jun. 10, 2010

Related U.S. Application Data

(60) Provisional application No. 61/121,399, filed on Dec. 10, 2008, provisional application No. 61/227,603, filed on Jul. 22, 2009, provisional application No. 61/263,150, filed on Nov. 20, 2009.

(51) Int. Cl.
*H04R 25/00* (2006.01)

(52) U.S. Cl.
CPC ..... *H04R 25/606* (2013.01); *H04R 2225/67* (2013.01); *H04R 2460/13* (2013.01)

(58) Field of Classification Search
CPC ..... H04R 25/00; H04R 25/55; H04R 25/60; H04R 25/604; H04R 25/606; H04R 25/608; H04R 2225/025; H04R 2225/49; H04R 2225/67
USPC ..... 600/25
See application file for complete search history.

(56) References Cited

U.S. PATENT DOCUMENTS

| | | | | |
|---|---|---|---|---|
| 3,030,455 A | | 4/1962 | Pearson | 179/107 |
| 3,209,081 A | | 9/1965 | Ducote et al. | 600/25 |
| 3,603,305 A | | 9/1971 | Oppenheimer | 606/204.25 |
| 3,870,832 A | * | 3/1975 | Fredrickson | 600/25 |
| 4,352,960 A | | 10/1982 | Dormer et al. | 607/57 |
| 4,498,461 A | | 2/1985 | Hakansson | 600/25 |

(Continued)

FOREIGN PATENT DOCUMENTS

| | | | |
|---|---|---|---|
| WO | WO 2005037153 A1 | 4/2005 | A61F 5/58 |
| WO | WO 2008036165 A2 | 3/2008 | H04R 25/00 |

OTHER PUBLICATIONS

European Patent Office, EP Supplementary Search Report, EP Patent Application No. 07750546.9, PCT/US2007003716, dated Feb. 12, 2009, 9 pages.

(Continued)

*Primary Examiner* — Catherine B Kuhlman
*Assistant Examiner* — Thaddeus Cox
(74) *Attorney, Agent, or Firm* — Sunstein Kann Murphy & Timbers LLP

(57) ABSTRACT

An implantable hearing prosthesis for a recipient patient is described. An implantable receiving coil transcutaneously receives an externally generated communication data signal. An implantable signal processor is in communication with the receiving coil and converts the communication data signal into an electrical stimulation signal. An implantable transducer housing is fixedly attachable to skull bone of the patient. An implantable drive transducer is in communication with the signal processor and removably engageable with the transducer housing for applying to the transducer housing a mechanical vibration signal based on the electrical stimulation signal for audio perception by the patient.

7 Claims, 12 Drawing Sheets

(56) References Cited

U.S. PATENT DOCUMENTS

| | | | | |
|---|---|---|---|---|
| 4,606,329 | A | 8/1986 | Hough | 600/25 |
| 4,612,915 | A | 9/1986 | Hough et al. | 600/25 |
| 4,982,434 | A | 1/1991 | Lenhardt et al. | 381/326 |
| 5,015,224 | A * | 5/1991 | Maniglia | 600/25 |
| 5,798,582 | A * | 8/1998 | Neff | 310/13 |
| 5,842,967 | A | 12/1998 | Kroll | 600/25 |
| 5,913,815 | A | 6/1999 | Ball et al. | 600/25 |
| 6,161,046 | A | 12/2000 | Maniglia et al. | 607/57 |
| 6,315,710 | B1 | 11/2001 | Bushek et al. | 600/25 |
| 6,735,318 | B2 | 5/2004 | Cho | 381/326 |
| 7,266,208 | B2 | 9/2007 | Charvin et al. | 381/328 |
| 2001/0003788 | A1 * | 6/2001 | Ball et al. | 600/25 |
| 2005/0261544 | A1 * | 11/2005 | Gan | 600/25 |
| 2006/0183965 | A1 * | 8/2006 | Kasic et al. | 600/25 |
| 2007/0156011 | A1 | 7/2007 | Westerkull | 600/25 |
| 2007/0191673 | A1 * | 8/2007 | Ball et al. | 600/25 |
| 2008/0051623 | A1 * | 2/2008 | Schneider et al. | 600/25 |
| 2009/0092271 | A1 * | 4/2009 | Fay et al. | 381/328 |
| 2009/0281368 | A1 * | 11/2009 | Krubsack et al. | 600/25 |

OTHER PUBLICATIONS

Officer Tomasz Rogala, European Patent Office, International Search Report and Written Opinion, PCT/US2009/067456, mailed Feb. 24, 2010, 12 pages.

* cited by examiner

SKULL VIBRATIONAL UNIT

This application claims priority from U.S. Provisional Patent Application 61/263,150, filed Nov. 20, 2009, and from U.S. Provisional Patent Application 61/227,603, filed Jul. 22, 2009, and from U.S. Provisional Patent Application 61/121,399, filed Dec. 10, 2008, which are incorporated herein by reference.

FIELD OF THE INVENTION

The present invention relates to medical implants, and more specifically to a novel bone conduction transducer for an implantable hearing prosthesis.

BACKGROUND ART

A normal ear transmits sounds as shown in FIG. 1 through the outer ear 101 to the tympanic membrane (eardrum) 102, which moves the ossicles of the middle ear 103 (malleus, incus, and stapes) that vibrate the oval window and round window openings of the cochlea 104. The cochlea 104 is a long narrow organ wound spirally about its axis for approximately two and a half turns. It includes an upper channel known as the scala vestibuli and a lower channel known as the scala tympani, which are connected by the cochlear duct. The cochlea 104 forms an upright spiraling cone with a center called the modiolar where the spiral ganglion cells of the acoustic nerve 113 reside. In response to received sounds transmitted by the middle ear 103, the fluid-filled cochlea 104 functions as a transducer to generate electric pulses which are transmitted to the cochlear nerve 113, and ultimately to the brain.

Hearing is impaired when there are problems in the ability to transduce external sounds into meaningful action potentials along the neural substrate of the cochlea 104. To improve impaired hearing, various types of hearing prostheses have been developed. For example, when hearing impairment is associated with the cochlea 104, a cochlear implant with an implanted stimulation electrode can electrically stimulate auditory nerve tissue within the cochlea 104 with small currents delivered by multiple electrode contacts distributed along the electrode. FIG. 1 also shows some components of a typical cochlear implant system which includes an external microphone that provides audio information to an external signal processor 111 where various signal processing schemes can be implemented. The processed data communications signal with the audio information is then converted into a digital data format, such as a sequence of data frames, for transcutaneous transmission by an external transmitting coil 107 to a corresponding receiving coil in an implant processor 108. Besides extracting the audio information from the data communications signal, the implant processor 108 also performs additional signal processing such as error correction, pulse formation, etc., and produces a stimulation pattern (based on the extracted audio information) that is sent through an electrode lead 109 to an implanted electrode array 110. Typically, this electrode array 110 includes multiple electrodes on its surface that provide selective stimulation of the cochlea 104.

When hearing impairment is related to operation of the middle ear 103, a conventional hearing aid may be used to provide acoustic-mechanical vibration to the auditory system. With conventional hearing aids, a microphone detects sound which is amplified and transmitted in the form of acoustical energy by a speaker or another type of transducer into the middle ear 103 by way of the tympanic membrane 102. Interaction between the microphone and the speaker can sometimes cause an annoying and painful a high-pitched feedback whistle. The amplified sound produced by conventional hearing aids also normally includes a significant amount of distortion.

Efforts have been made to eliminate the feedback and distortion problems using middle ear implants that employ electromagnetic transducers. A coil winding is held stationary by attachment to a non-vibrating structure within the middle ear 103 and microphone signal current is delivered to the coil winding to generate an electromagnetic field. A magnet is attached to an ossicle within the middle ear 103 so that the magnetic field of the magnet interacts with the magnetic field of the coil. The magnet vibrates in response to the interaction of the magnetic fields, causing vibration of the bones of the middle ear 103. See U.S. Pat. No. 6,190,305, which is incorporated herein by reference.

Middle ear implants using electromagnetic transducers can present some problems. Many are installed using complex surgical procedures which present the usual risks associated with major surgery and which also require disarticulating (disconnecting) one or more of the bones of the middle ear 103. Disarticulation deprives the patient of any residual hearing he or she may have had prior to surgery, placing the patient in a worsened position if the implanted device is later found to be ineffective in improving the patient's hearing.

U.S. Patent Publication 20070191673 and U.S. Provisional Patent Application 61/121,399, filed Dec. 10, 2008, which are incorporated herein by reference, describe driving a relatively large inertial mass to vibrate the skull bone of a hearing impaired patient. As shown in FIG. 2, a floating mass transducer (FMT) 203 is mechanically connected to the temporal bone of the patient. The mass of the floating mass transducer (FMT) 203 vibrates in response to the audio information in a data communications signal originating from an external processor 201 and transmitted to an implanted receiving coil 202. Bone conduction of the FMT vibrations through the temporal bone are transduced into fluid motion within the cochlea and perceived as sound.

SUMMARY OF THE INVENTION

Embodiments of the present invention include an implantable hearing prosthesis for a recipient patient. An implantable receiving coil transcutaneously receives an externally generated communication data signal. An implantable signal processor is in communication with the receiving coil and converts the communication data signal into an electrical stimulation signal. An implantable transducer housing is fixedly attachable to skull bone of the patient. An implantable drive transducer is in communication with the signal processor and removably engageable with the transducer housing for applying to the transducer housing a mechanical vibration signal based on the electrical stimulation signal for audio perception by the patient.

In some embodiments, the transducer housing may be adapted for fixed attachment to the skull bone by a pair of radially opposed bone screws and/or into a recessed housing well in the skull bone. The transducer housing may include a hermetically sealed can arrangement—for example, sealing by a silicone elastomer.

In some specific embodiments, the drive transducer may be an electromagnetic transducer and may include an electromagnetic drive coil that is removably insertable into the transducer housing. An encapsulation layer of biocompatible material may cover the drive coil. A sealing lens of biocompatible material may be across an outer axial end of the drive coil. A coupling spring may couple the drive coil to the transducer housing.

In some embodiments, the drive transducer may be a piezoelectric transducer. For example, an inertial mass may be coupled to a piezoelectric stack containing piezoelectric elements stacked parallel to the surface of the skull bone. A coupling bow of stiff material may connect the inertial mass to the piezoelectric stack. Or the drive transducer include an inertial mass coupled to a piezoelectric stack containing piezoelectric elements stacked perpendicular to the surface of the skull bone and a coupling diaphragm of stiff material may couple the drive transducer to the transducer housing.

Embodiments of the present invention also include an implantable hearing prosthesis for a recipient patient. A receiving coil transcutaneously receives an externally generated communication data signal. A signal processor is in communication with the receiving coil and converts the communication data signal into an electrical stimulation signal. A bone conduction transducer is in communication with the signal processor and converts the electrical stimulation signal into a mechanical vibration signal. Two single mounting points are opposite each other on an outer perimeter of the bone conduction transducer and mechanically connect the bone conduction transducer to the skull bone of the patient so as to couple the mechanical vibration signal by bone conduction to the cochlea. The mounting points specifically may be adapted to receive bone screws for connecting the bone conduction transducer to the skull bone.

In some embodiments, the bone conduction transducer may be a floating mass transducer, for example, using a dual opposing magnet arrangement. Or the bone conduction transducer may be a piezoelectric transducer, for example, using multiple stacked piezoelectric members. In some embodiments, the bone conduction transducer may be an electromagnetic mass transducer, for example, with one or more electromagnetic coils surrounding a permanent magnet member. There may be one or more connector members (e.g., based on a flexible diaphragm) that flexibly connect the permanent magnet member and the one or more electromagnetic coils. And there may be a cylindrical coil housing that contains the one or more electromagnetic coils.

There may also be a silicone elastomer receiver housing that contains the receiving coil. A titanium transducer housing may contain the bone conduction transducer. The bone conduction transducer may be suspended beneath the mounting points in a recess in the skull bone. An unbiased pivot may connect the receiving coil to the bone conduction transducer to allow positioning of the receiving coil and the bone conduction transducer in non-parallel planes without residual bias force.

DETAILED DESCRIPTION OF SPECIFIC EMBODIMENTS

Figure 1:
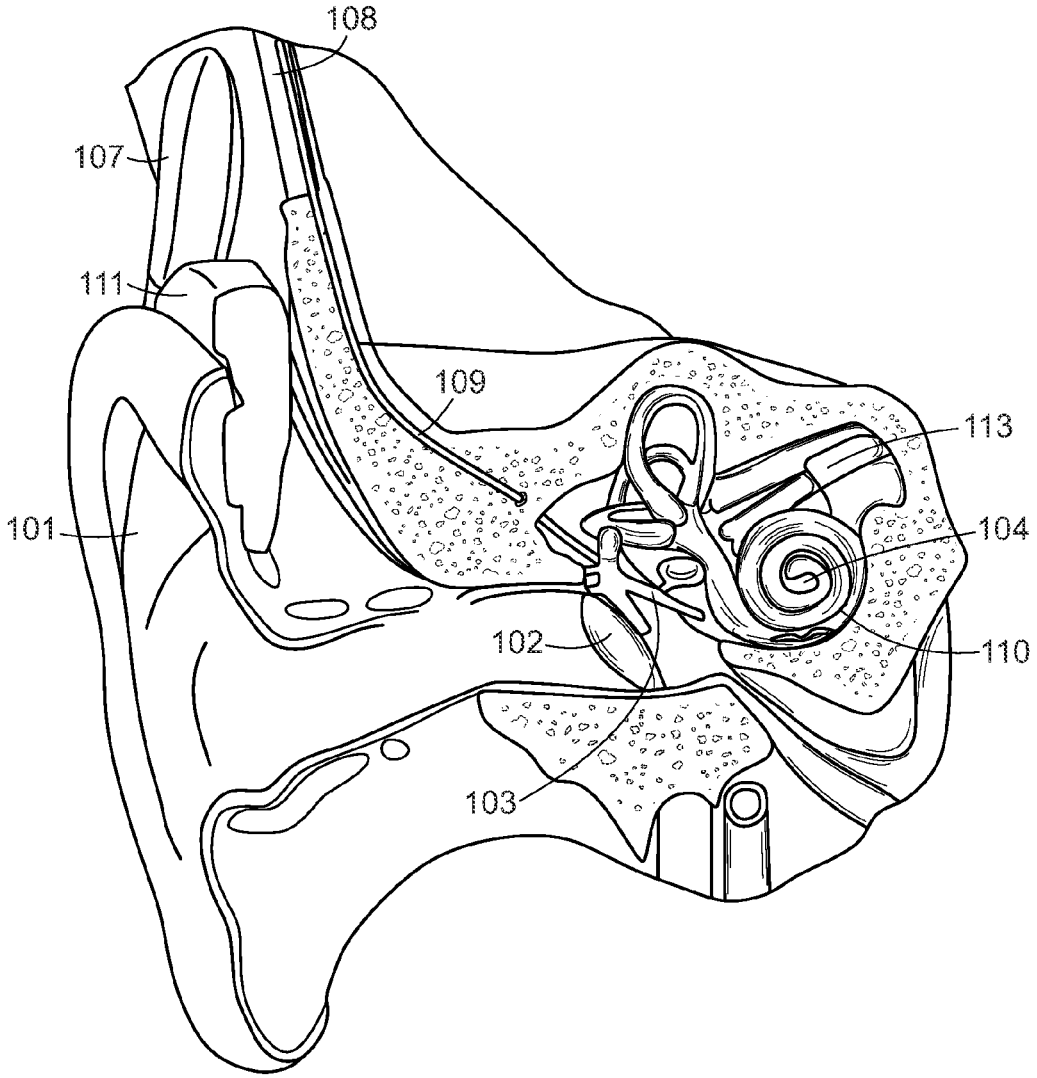
FIG. 1 shows structures of a typical ear which includes a cochlear implant.
Figure 2:
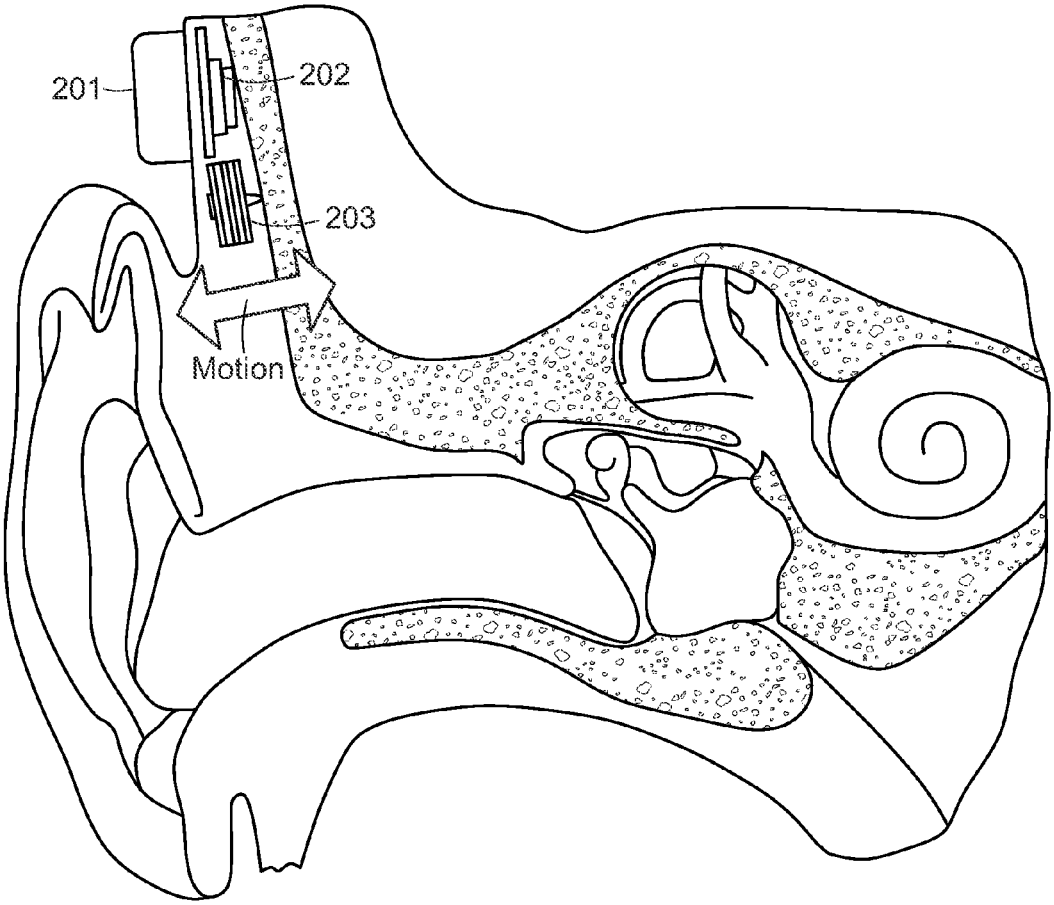
FIG. 2 illustrates the operating principle of a bone conduction prosthesis.
Figure 3A:
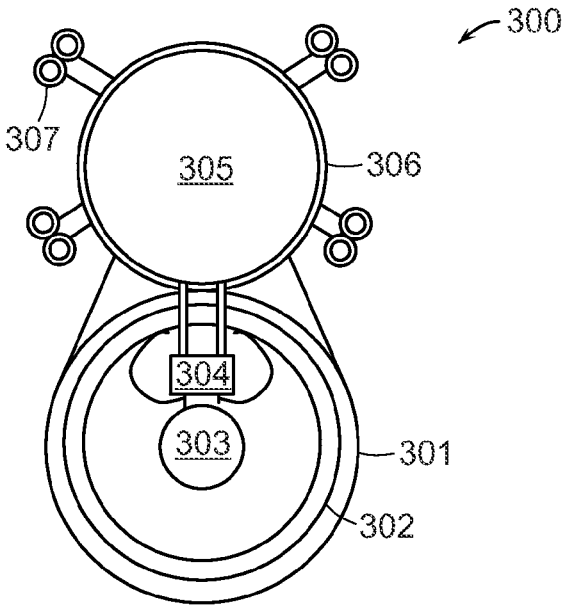
FIG. 3 shows an example of a prior art bone conduction prosthesis.
Figure 3B:
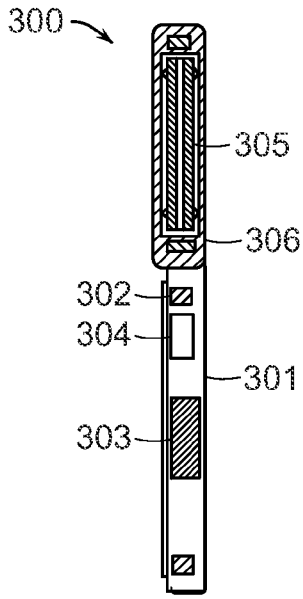

FIG. 3 shows elements of an implantable hearing prosthesis as described, for example, in U.S. Patent Publication 20070191673 ("Ball '673"), which is based on driving a relatively large mass to vibrate the skull bone of a hearing impaired patient. Bone conduction of these vibrations is transduced into fluidic vibration within the cochlea that is sensed by the patient as sound. More specifically, FIG. 3A shows a top plan view and FIG. 3B shows a side cross-section view of an implantable hearing prosthesis 300 using an inertial mass-based bone conduction transducer. A silicone elastomer receiver housing 301 contains a receiving coil 302 that transcutaneously receives communications signals from the external audio processor, and a holding magnet 303 that cooperates with a corresponding external magnet to hold the external audio processor in correct position over the receiving coil 302. An implant signal processor 304 receives the communications signals from the receiving coil 302 and produces a corresponding electrical stimulation signal to a bone conduction transducer 305, specifically, a dual opposing magnet type floating mass transducer (FMT), which is enclosed in a titanium transducer housing 306. Mounting of the transducer housing 306 to the skull bone is accomplished by multiple pairs of attachment ears 307 which are surgically mounted to the bone with connecting screws. The FMT mass of the bone conduction transducer 305 vibrates in response to the electrical stimulation signal from the implant signal processor 304, which in turn causes inertial vibration of the transducer housing 306. The housing vibrations are transduced through the temporal bone by bone conduction into fluid motion within the cochlea and perceived as sound.

While an improvement in the field, the implantable hearing prosthesis 300 of Ball '673 is not without issues. For example, the Ball '673 implantable hearing prosthesis 300 has multiple mounting holes which require a high degree of planarity in the bone surrounding the implantation site. And the Ball '673 implantable hearing prosthesis 300 is configured such that in a relaxed state, the receiver housing 301 and the transducer housing 306 are biased to lie in a single plane. Thus, when implanted onto the curved skull bone of a recipient patient, this existing bias exerts a force that tends to pull the two housings back into a common plane, away from the curvature of the underlying skull bone.

Figure 4:
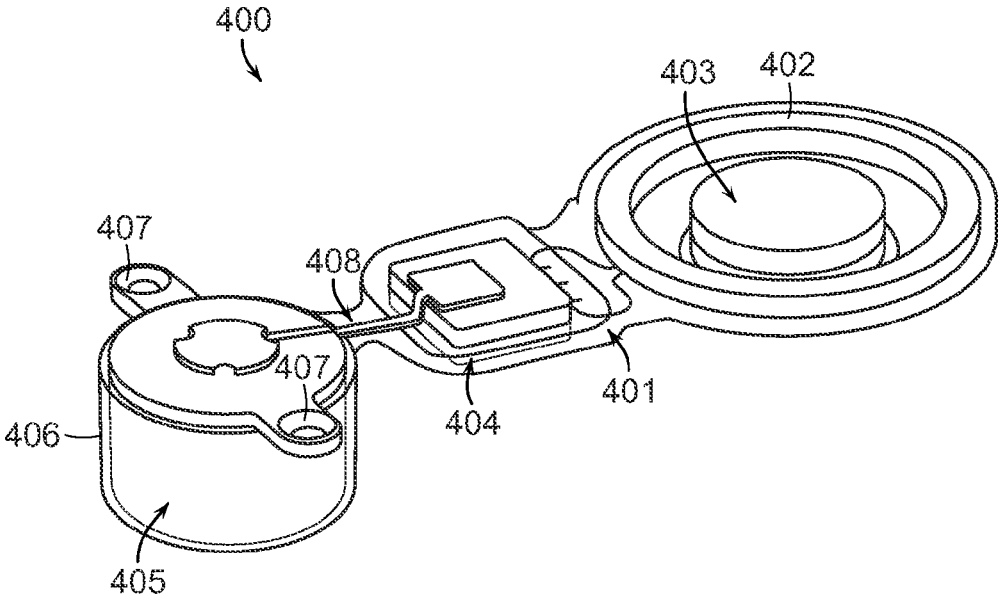
FIG. 4 shows an example of an implantable hearing prosthesis according to an embodiment of the present invention.

Embodiments of the present invention are directed to an implantable bone conduction hearing prosthesis with various improvements over the earlier Ball '673 device. FIG. 4 shows one example of such an implantable hearing prosthesis 400 having a silicone elastomer receiver housing 401 (e.g., about 4.5 mm thick) that contains a receiving coil 402 and a holding magnet 403. Implant signal processor 404 receives the communications signals from the receiving coil 402 and produces a corresponding electrical stimulation signal to a bone conduction transducer 405, which is a dual opposing magnet type floating mass transducer (FMT). The FMT mass of the bone conduction transducer 405 is enclosed in a titanium transducer housing 406, which typically may be about 17 mm across and about 11 mm in depth.

Figure 5:
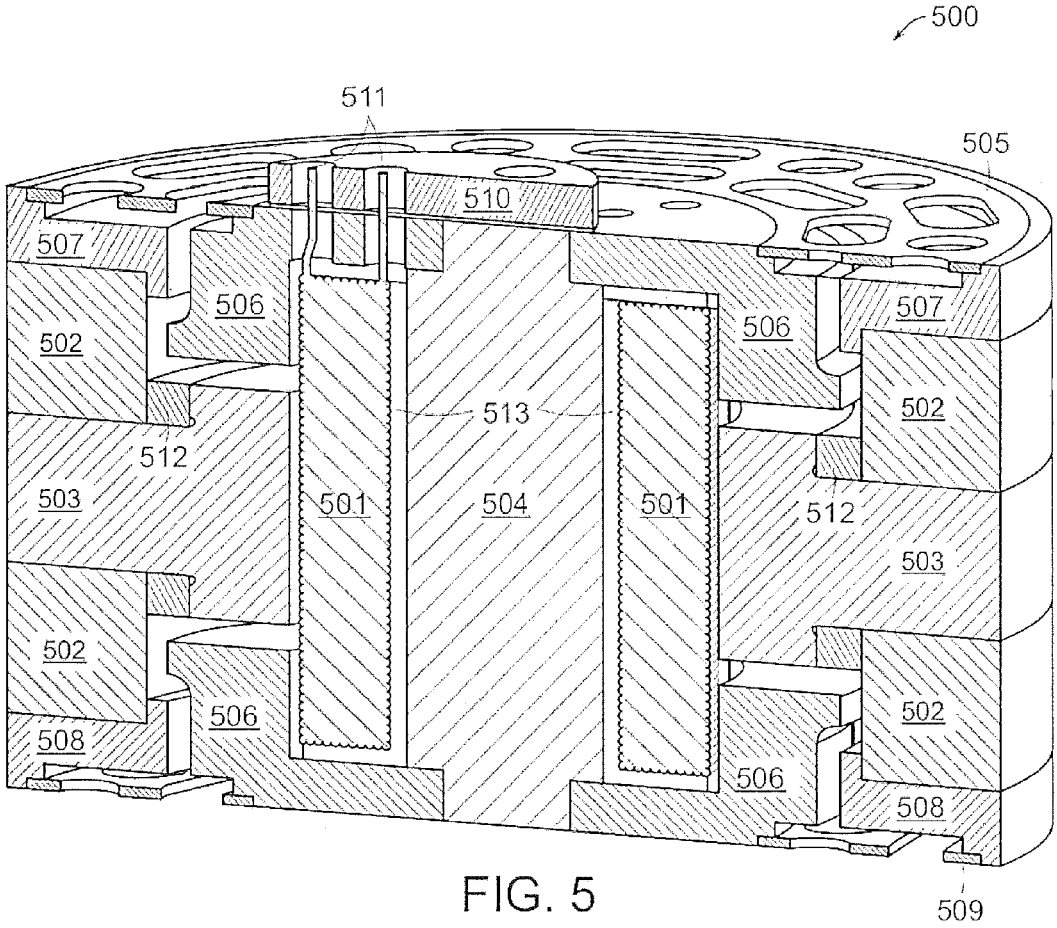
FIG. 5 shows various structural details of a transducer according to one embodiment of the present invention.

FIG. 5 shows various internal structural details of a bone conduction transducer 500 for an implantable hearing prosthesis 400 as shown in FIG. 4. An axially central electromagnetic coil 501 is surrounded by a coil spacer 513, a central base core 504, and core spacer 506. The central base core 504 and core spacer 506 are made of soft iron that increases the magnetic coupling of the magnetic field to provide a magnetic conduction path for the coil flux. Radially surrounding central core subassembly is a moveable subassembly of one or more ring-shaped permanent magnets 502 assembled together with a soft iron magnet carrier 503 and one or more magnet spacers 512. This moveable subassembly is attached to a top suspension subassembly of a top membrane spring 505 together with a soft iron top lid 507, and a bottom suspension subassembly of a bottom membrane spring 509 together with a soft iron bottom lid 508. The bias point of the permanent magnets 502 can be kept in a safe range (high B-field, low H-field) with respect to demagnetization from aging or external magnetic fields.

Operation of the transducer 500 is based on employing a motion constraint (e.g., the self-centering parallel membrane springs 505 and 509) to create a linear-mode inertial drive of electrical stimulation signals. The electrical stimulation signal from the implant signal processor 404 is received by coil feeds 511 in a coil feed clip 510 and developed by the electromagnetic coil 501 and base core 504. This produces a coil magnetic field that interacts with the base core 504, the one or more permanent magnets 502, and magnet carrier 503. The one or more permanent magnets 502 and magnet carrier 503 vibrate in response to the stimulation signal. This vibration of the transducer 500 is then coupled to the adjacent bone for bone conduction to the cochlea.

In addition, the arrangement of structural features in the transducer 500 avoids magnetic short circuits due to the air gaps between the moveable permanent magnets 502 and the non-moveable electromagnetic coil 501 and core spacer 506. The non-magnetic membrane springs 505 and 509 prevent these air gaps from collapsing when the transducer 500 is excited by an electrical stimulation signal (one of the moveable parts would magnetically stick to one of the core parts). Instead, when there is no stimulation signal, the forces in the air gaps generated by the magnetic bias flux compensate and balance each other. When an electrical stimulation signal is present and providing excitation to the transducer 500, the flux density will weakened in one of the air gaps and boosted in the other. The resulting net force is non-zero and the moveable subassembly moves in response. Vice versa, the transducer 500 can be used to generate a corresponding electrical signal from vibrational excitation, for example, to act as an implant sensor or to generate energy for the implant system. Closed-loop control applications may be realized by fitting the transducer 500 with a sensing element.

Inductance can be minimized in the electromagnetic coil 501 by controlling stray magnetic flux. Mechanical resonance frequency of the transducer 500 also can be fine tuned in various ways such as by spring trimming with a cutting laser. Eddy currents can be used in the transducer 500 to provide dampening of resonance peaks by magnetically non-conductive short circuit elements. Some embodiments may also immerse components in a viscous fluid for additional dampening.

Compared to prior inertial transducers, the transducer 500 in FIG. 5 better maximizes the inertia of the involved masses (and also thereby achieving lower resonance frequencies) by having the moveable subassembly of the permanent magnets 502 and magnet carrier 503 radially outside the electromagnetic coil 501 and central base core 504. Similarly, having loss-generating components such as the electromagnetic coil 501 closer to the axial center of the transducer 500, higher efficiency is enjoyed as compared to prior art arrangements.

Such an arrangement is also easily manufacturable because of the rotationally symmetric design, use of relatively massive non-laminated yoke components with low electrical conductivity. In addition, it may be useful to use multiple separate yoke parts and/or use components with self-centering characteristics. Radial slots in one or more of the yoke components may also be useful for minimizing the influence of eddy currents. Such an arrangement also minimizes distortion compared to prior art designs by intentionally introducing ferromagnetic saturation in certain yoke regions by stabilizing constant bias flux. Besides use for bone conduction hearing applications, a transducer 500 may be useful in other types of applications such as for bone healing, a membrane pump, energy harvesting, active vibration dampening, hydraulic valves, loudspeakers, and/or vibration exciter.

Returning to FIG. 4, the receiver housing 401 and the transducer housing 406 are connected at an unbiased pivot point 408. The unbiased pivot point 408 allows the receiver housing 401 to be bent out of the plane containing the upper surface of the transducer housing 406 so that it lies correctly in a relaxed condition in proper position under the skin, without the kind of undesirable bias force found in the devices described in Ball '863 that tends to flex the receiver housing back towards the plane of the transducer housing. Such unbiased bending of the housings relative to each other is helpful for accommodating different sizes of patient skulls and corresponding varying amounts of skull bone curvature. Some skulls are relatively smaller and therefore need relatively more bend between the housings, while other skulls are relatively larger and little or no bending of the housings may be needed. In one specific embodiment, the receiver housing 401 can be bent without residual biasing force up to 180 degrees from a 90 degree superior to a 90 degree inferior position in relation to the transducer housing 406.

Mounting of the transducer housing 406 to the skull bone is accomplished by two single mounting points 407 which are opposite to each other on the outer perimeter of the transducer housing 406 so as to couple the mechanical vibration signal from the bone conduction transducer 405 via bone conduction to the cochlea. The use of two single mounting points 407 in the implantable hearing prosthesis 400 avoids some of the bone planarity issues associated with the multiple mounting point embodiments described in Ball '673. The mounting points 407 may be secured to the skull bone with single-use self-tapping bone screws, e.g., 6-8 mm in length. Use of self-drilling screws may cause micro-fractures in the bone. In some patients, it may be preferred to use different length bone screws in each mounting point 407.

An implantable hearing prosthesis 400 can be implanted in a relatively simple surgical procedure that may take as little as 30 minutes. The surgeon creates a skin incision over the desired location of the device, a bone bed is prepared, and screw holes are pre-drilled for the mounting screws. An implant template may be useful for these steps to aid in preparation of the proper size and shape bed and/or to act as a drill guide for drilling of the screw holes. The hearing prosthesis 400 is inserted into position and secured with the mounting screws which are tightened to a defined torque. Then the receiving housing 401 is bent into proper position at the unbiased pivot point 408, and the incision is closed.

Figure 6A:
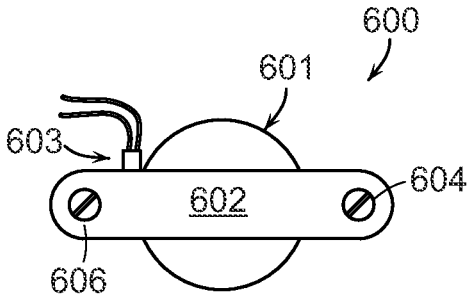
FIG. 6 A-C shows various views of a bone conducting transducer according to one specific embodiment of the present invention based on a piezoelectric inertial mass arrangement.
Figure 6B:
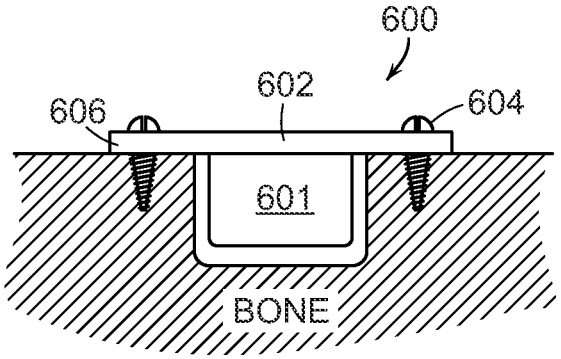
Figure 6C:
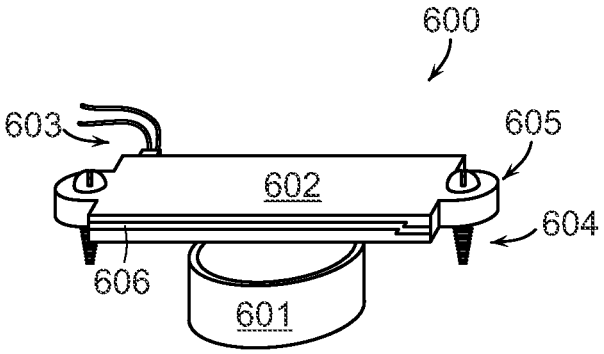
Figure 7A:
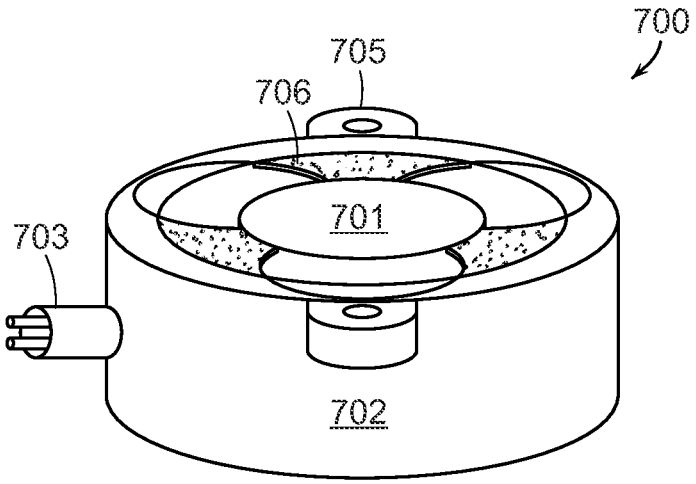
FIG. 7 shows A-E shows various views of a bone conducting transducer according to one specific embodiment of the present invention based on an arrangement of one or more electromagnetic coils that interact with a permanent magnet inertial mass.
Figure 7B:
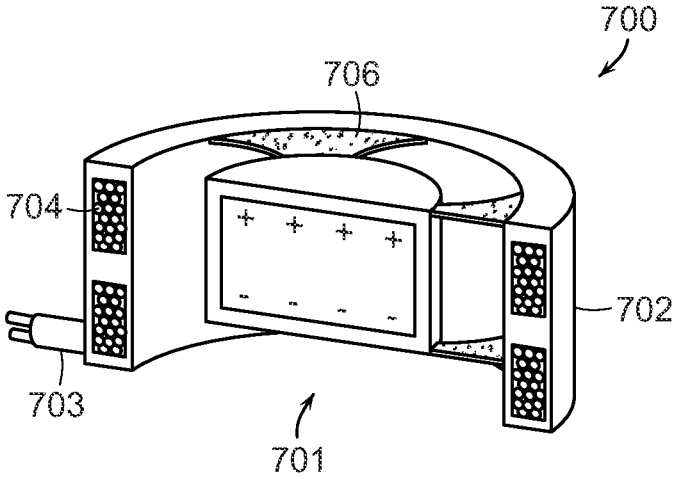
Figure 7C:
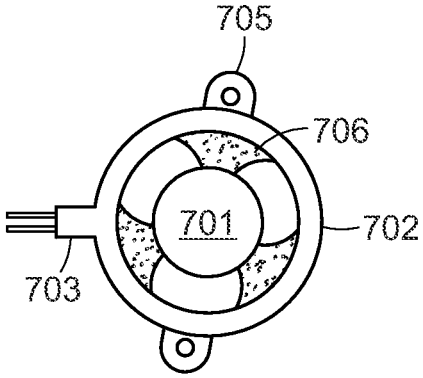
Figure 7D:
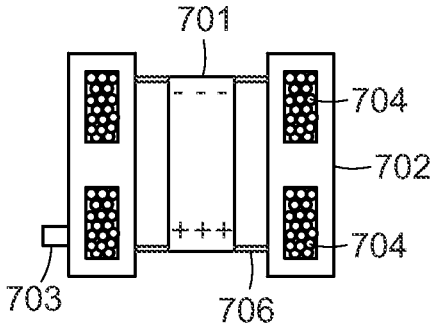
Figure 7E:
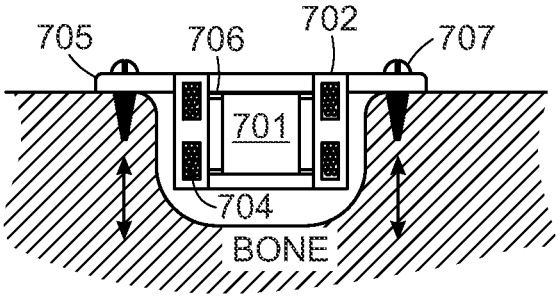

FIG. 6 A-C shows various views of one specific embodiment of a bone conduction transducer 600 for an implantable hearing prosthesis which uses one or more piezoelectric members 606. Signal input 603 is a feed-through wiring arrangement that receives an electrical stimulation signal from an implant signal processor. A transducer housing 601 is suspended below the piezoelectric members 606 in a prepared bone recess which surrounds the inertial mass housing 601. The piezoelectric members 606 respond to the electrical stimulation signal with corresponding mechanical vibrations. The mechanical vibrations are also imparted to the transducer housing 601 that is suspended below the piezoelectric members 606 and in effect amplifies the magnitude of the mechanical vibrations. The mechanical vibrations of the transducer housing 601 and the piezoelectric members 606 are coupled through mounting points 606 and corresponding connecting screws 604 which attach to the skull bone (such as the cortical bone or the temporal bone of the patient), and carried by bone conduction to the cochlea to be perceived as sound.

FIG. 7 A-E shows various views of another embodiment a bone conduction transducer 700 of an implantable hearing prosthesis based on an inertial mass housing arrangement which includes one or more electromagnetic coils 704 surrounding a permanent magnet 701 for responding to the electrical stimulation signal with the corresponding mechanical vibrations. In this case, the electromagnetic coils 704 are contained in a hermetic cylindrical coil housing 702 made of titanium within which is the inertial mass of the permanent magnet 701. The permanent magnet 701 is flexibly suspended within the center of the coil housing 702 by a flexible connector member 706. In the example shown, the flexible connector member 706 is in the specific form of arcuate segments of a flexible diaphragm.

Operation of this embodiment can most clearly be seen from the view shown in FIG. 6E. The electromagnetic coils 704 respond to the electrical stimulation signal with a varying electromagnetic field that in turn interacts with the permanent magnet 701 to generate corresponding mechanical vibration that moves the permanent magnet 701 up and down. The mechanical vibrations are coupled through the flexible connector member 706 to the coil housing 702 to the mounting points 705 and corresponding connecting screws 707 which attach to the skull bone (such as the cortical bone or the temporal bone of the patient). The skull bone then conducts the audio information of the mechanical vibrations to the cochlea.

Figure 8A:
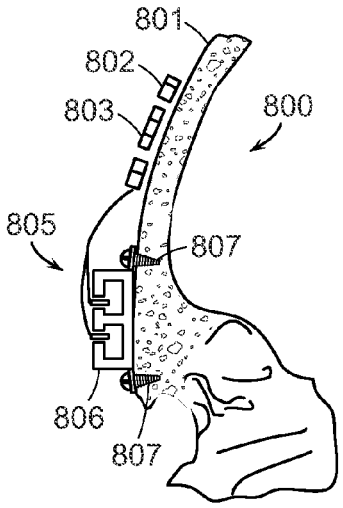
FIG. 8 A-C shows various details of an embodiment having an easily insertable and removable drive transducer.
Figure 8B:
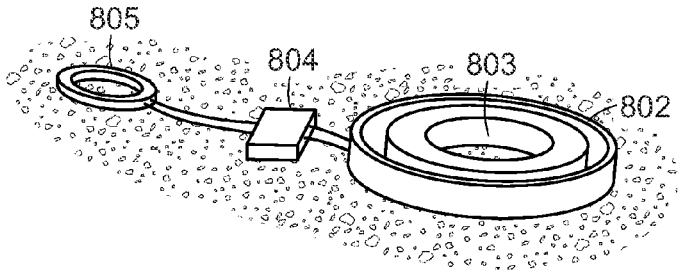
Figure 8C:
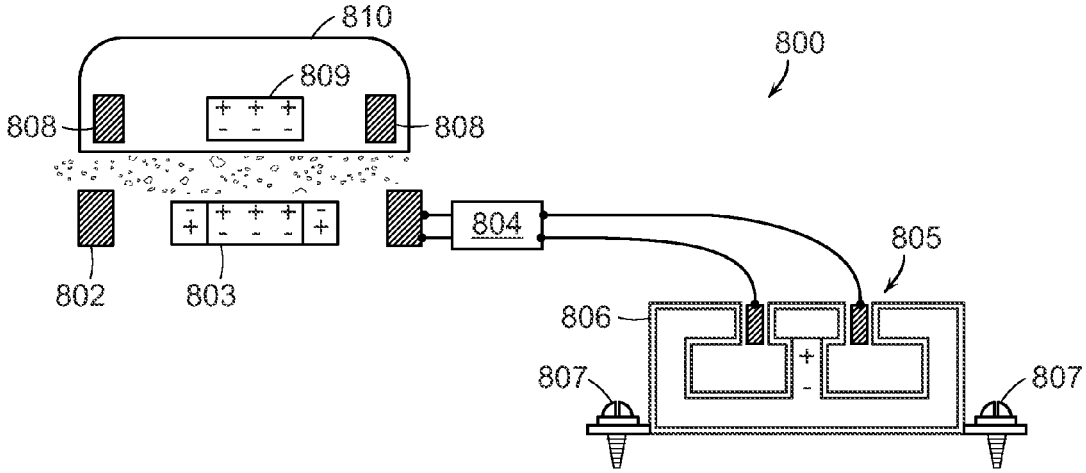

FIG. 8 A-C shows various views of another embodiment of the present invention. An external processor 810 contains one or more sensing microphones for sensing the acoustic environment around a patient user and generating a corresponding microphone signal. From the microphone signal the external processor generates a representative communication data signal which is transcutaneously transmitted by an external transmitting coil 808 to an implanted receiving coil 802. An implant magnet 803 within the receiving coil 802 magnetically interacts with a corresponding external holding magnet 809 within the transmitting coil 808 to hold the external processor 810 in a correct position. An implantable signal processor 804 converts the communication data signal from the receiving coil 802 into a representative electrical stimulation signal. An implantable transducer housing 806 is fixedly attachable to the skull bone 801 of the patient. An implantable drive transducer 805, in this case an electromagnetic drive coil, is in communication with the signal processor 804 and removably engageable with the transducer housing 806 for applying to the transducer housing 806 a mechanical vibration signal based on the electrical stimulation signal for audio perception by the patient.

Figure 9A:
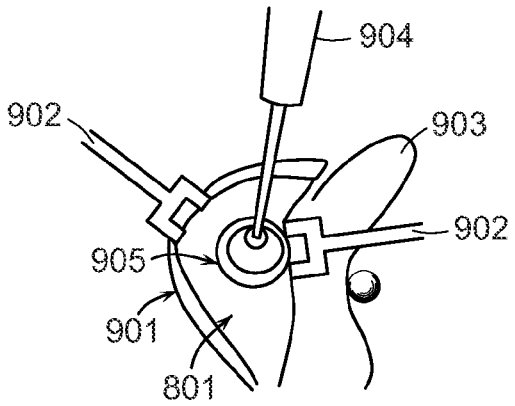
FIG. 9 A-C shows details of a surgical procedure for inserting an embodiment such as the one shown in FIG. 8.
Figure 9B:
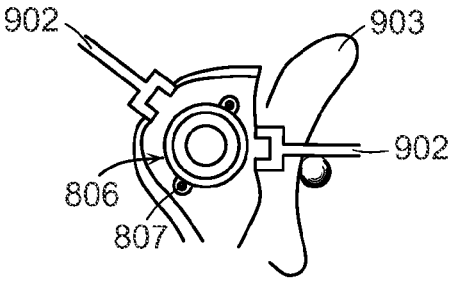
Figure 9C:
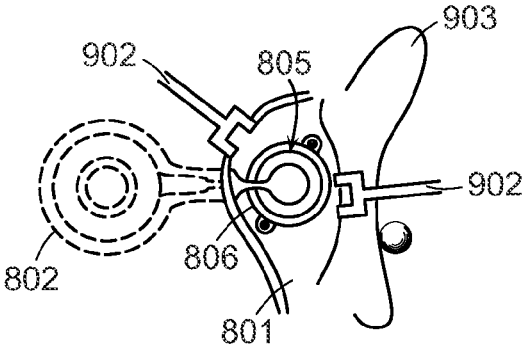

In the embodiment shown in FIG. 8, transducer housing 806 is fixedly attached to the skull bone 801 during a surgical procedure such as the one shown in FIG. 9 A-C. In FIG. 9A, a surgical incision 901 is made in the patient's skin around the site of the transducer housing 806 behind the ear auricle 903. Retractors 902 pull back the skin and ear auricle 903 from the surgical site to provide access for a surgical drill 904 to prepare a recessed bone well in the skull bone 801. The transducer housing 806 is then fixed in place in the bone wells by a pair of radially opposed bone screws 807, after which the remainder of the prosthetic system is implanted including inserting the drive transducer 805 into the ready transducer housing 806. Then later, if any portion of the system needs replacement, the drive transducer 805 can be easily withdrawn from the transducer housing 806 during a simple surgical procedure without disturbing the existing connection with the patient skull bone 801.

Figure 10A:
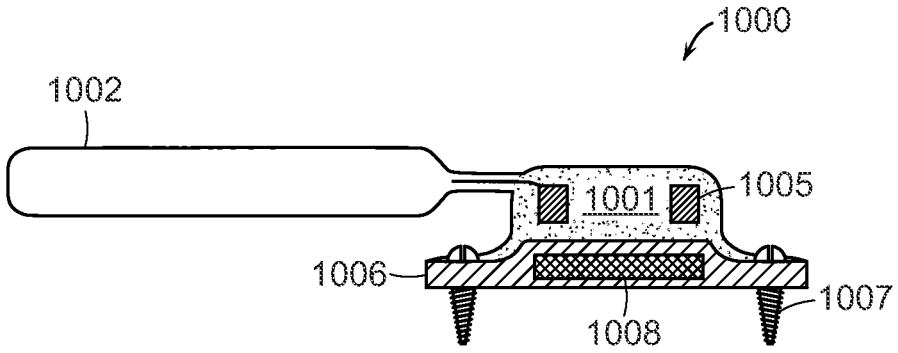
FIG. 10 A-C shows various alternative structural details according to specific embodiments.
Figure 10B:
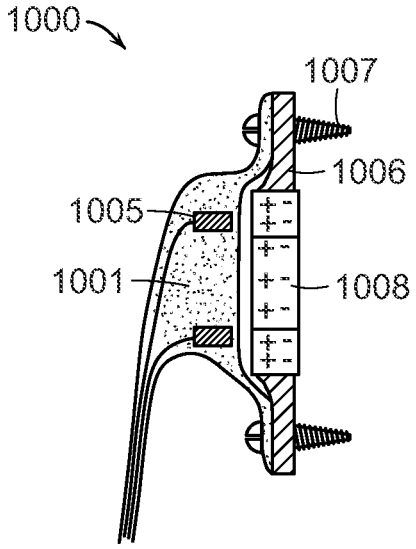
Figure 10C:
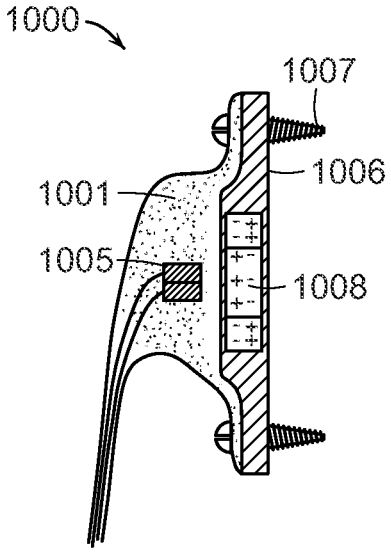

FIG. 10 A-C shows an embodiment of an implantable prosthesis system 1000 wherein a silicone elastomer mold 1001 encases an electromagnetic drive coil 1005 (e.g., made polyimed coated gold wire) together in a sealed engagement with a low-profile transducer housing 1006. The silicone elastomer mold 1001 provides protective encasing of the drive coil 1005 and may also act as a spring to enhance long term stability and reduce signal distortion. The low-profile transducer housing 1006 includes a drive magnet 1008 which interacts with the electromagnetic drive coil 1005 to couple the mechanical vibration signal to the underlying skull bone. FIG. 10C shows a variation in which the drive magnet 1008 has a coaxial double magnet arrangement where the center has a first magnetic polarity and the outer ring has a second opposite magnetic polarity. In this embodiment, the drive coil 1005 may be arranged correspondingly, for example, in a tight central structure that interacts mainly with the center of the drive magnet 1008.

Figure 11A:
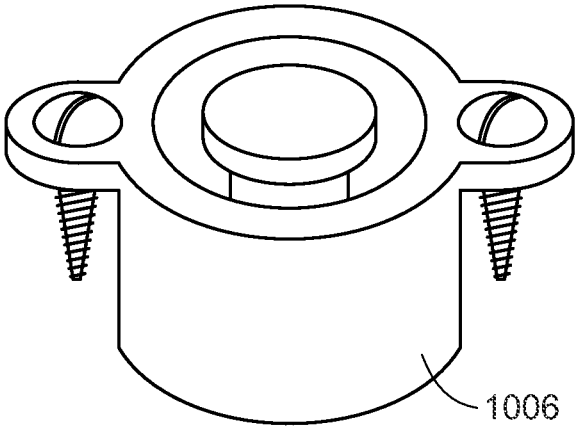
FIG. 11 A-B shows different height transducer housings according to different embodiments.
Figure 11B:
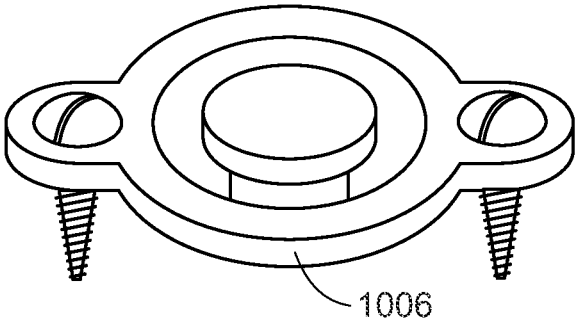

FIG. 11 A-B shows embodiments having different height profiles on the transducer housing 1106. In both embodiments, the transducer housing 1106 forms a hermetically sealed can, but in the embodiment shown in FIG. 11A, the transducer housing is much higher, e.g., about the same as the diameter of the housing, typically around 10 mm. FIG. 11B shows a lower height transducer housing 1106 which has a height much less than the diameter of the housing, e.g., about 5 mm. Where the height of the transducer housing 1106 is higher such as shown in FIG. 11A, it is more likely that a recessed bone well may be needed where the housing is fixed the skull bone in order to accommodate the relatively high profile of the housing. On the other hand, where the height of the transducer housing 1106 is lower as shown in FIG. 11B, it may be that the housing can be correctly attached to the skull bone with needing a recessed bone well, thereby making surgical installation much easier.

Figure 12A:
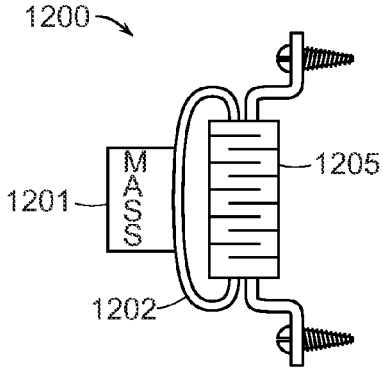
FIG. 12 A-C shows structural details of embodiments based on piezoelectric elements.

In some embodiments, the drive transducer may be a piezoelectric transducer. For example, FIG. 12A shows an embodiment of a drive transducer 1200 having an inertial mass 1201 that is coupled to a piezoelectric stack 1205 containing piezoelectric elements stacked parallel to the surface of the skull bone. In this embodiment, a coupling bow 1202 of stiff material (e.g., titanium) provides the mechanical connection of the inertial mass 1201 to the piezoelectric stack 1205.

Figure 12B:
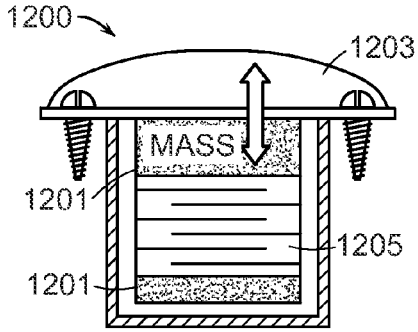
Figure 12C:
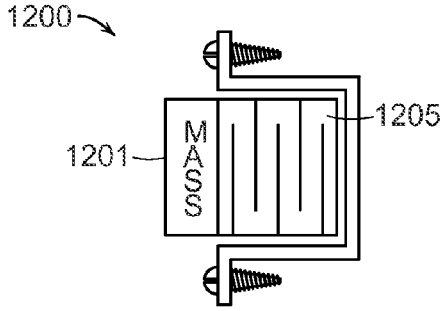

FIG. 12B shows an embodiment where the drive transducer 1200 includes opposing inertial masses 1201 at either end of a piezoelectric stack 1205 containing piezoelectric elements stacked perpendicular to the surface of the skull bone. A coupling diaphragm 1203 of stiff material (e.g., titanium) mechanically connects the drive transducer 1200 to the skull bone. FIG. 12C shows another embodiment where the drive transducer 1200 includes a single inertial mass 1201 at one end of a piezoelectric stack 1205 containing piezoelectric elements stacked perpendicular to the surface of the skull bone.

Figure 13A:
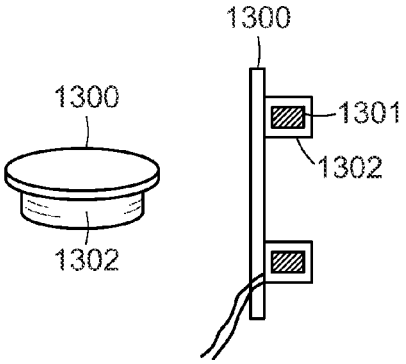
FIG. 13 A-B shows various structural details of en electromagnetic drive coil according to an embodiment.
Figure 13B:
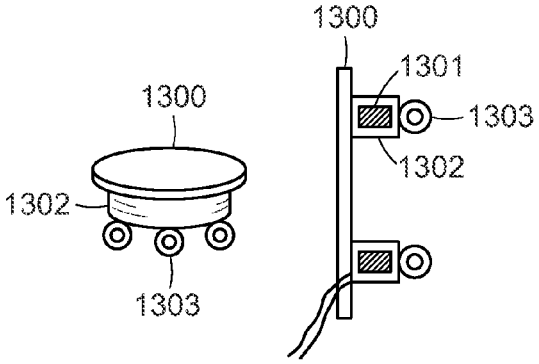

In some embodiments, shown for example in FIG. 13 A-B, the drive coil 1301 may be covered by an encapsulation layer 1302 of biocompatible material such as silicone or acrylic. In the specific embodiments shown in FIG. 13 A-B, the outer axial end of the drive coil 1301 has a sealing lens 1300 of biocompatible material which helps with the installation of the drive coil 1301 in the transducer housing. Such a sealing lens 1300 may also act as a spring to help minimize signal distortion. The sealing lens 1300 in FIG. 13B also includes a separate coupling spring 1303 incorporated into the encapsulation layer 1302 at the inner axial end of the drive coil 1302 for coupling the drive coil 1302 to the transducer housing with minimal distortion and long term durability. In other embodiments, the transducer housing may include such a coupling spring.

Embodiments of the present invention may be most appropriate for patients with conductive hearing impairment exhibiting mixed hearing loss with bone conduction thresholds better than or equal to 45 dB HL at various audiogram evaluation frequencies. A physician considering use of such a device should fully assess the potential risks and potential benefits for the patient, bearing in mind the patient's complete medical history, and exercising sound medical judgment. Embodiments may be contraindicated for patients with an existing mastoid condition that precludes attachment of the transducer, patients with retrocochlear or central auditory disorders, and/or patients with any known allergies to any of the materials used in the device.

Although various exemplary embodiments of the invention have been disclosed, it should be apparent to those skilled in the art that various changes and modifications can be made which will achieve some of the advantages of the invention without departing from the true scope of the invention.

What is claimed is:

1. An implantable hearing prosthesis for a recipient patient, the prosthesis comprising:

a receiving coil for transcutaneous receiving of an externally generated communication data signal;

an implantable signal processor in communication with the receiving coil for converting the communication data signal into an electrical stimulation signal;

an implantable transducer housing for fixed attachment to skull bone of the patient, the housing forming a hermetically sealed can containing a fixed permanent magnet arrangement portion of an implantable transducer; and an implantable electromagnetic drive portion of the implantable transducer in communication with the signal processor and configured to be:

i. connected to and within the implantable transducer housing and engageable with the permanent magnet arrangement portion for applying to the transducer housing a mechanical vibration signal based on the electrical stimulation signal for audio perception by the patient, and ii. freely removable from the implantable transducer housing to be removed from the implantable transducer housing without detaching the implantable transducer housing from the skull bone.

2. A prosthesis according to claim 1, wherein the transducer housing is adapted for fixed attachment to the skull bone by a pair of radially opposed bone screws.

3. A prosthesis according to claim 1, wherein the transducer housing is adapted for fixed attachment into a recessed housing well in the skull bone.

4. A prosthesis according to claim 1, wherein the can is sealed by a silicone elastomer.

5. A prosthesis according to claim 1, further comprising:

an encapsulation layer of biocompatible material covering the electromagnetic drive portion.

6. A prosthesis according to claim 1, further comprising:

a sealing lens of biocompatible material across an outer axial end of the electromagnetic drive portion.

7. A prosthesis according to claim 1, further comprising:

a coupling spring coupling the electromagnetic drive portion to the transducer housing.

* * * * *